US005315732A

United States Patent [19]

Huefner et al.

[11] Patent Number: 5,315,732

[45] Date of Patent: May 31, 1994

[54] TOOTHBRUSH HAVING ADJUSTABLE BRUSHING PRESSURE

[76] Inventors: Norman F. Huefner, 11 Lindall St., Laguna Niguel, Calif. 92677; Frank J. Burrell, Jr., 22504 Warmside Ave., Torrance, Calif. 90505

[21] Appl. No.: 63,769

[22] Filed: May 20, 1993

[51] Int. Cl.[5] ..... A46B 9/04

[52] U.S. Cl. ..... 15/167.1; 15/144.1; 15/172; 15/143.1; 15/201

[58] Field of Search ..... 15/167.1, 167.2, 143.1, 15/144.1, 172, 201

[56] References Cited

U.S. PATENT DOCUMENTS

| | | | |
|---|---|---|---|
| 825,910 | 7/1906 | Kleinsorgen | 15/201 |
| 1,694,636 | 12/1928 | Barker | 15/167.1 |
| 4,520,526 | 6/1985 | Peters | 15/172 |
| 4,572,223 | 2/1986 | Rosenfeld | 15/167.1 |
| 5,105,499 | 4/1992 | Dirksing | 15/172 |

OTHER PUBLICATIONS

Journal of Clinical Dentistry, vol. II, No. 4, p. 107, 1991.

*Primary Examiner*—Philip R. Coe
*Assistant Examiner*—Gary K. Graham
*Attorney, Agent, or Firm*—Gilbert Kivenson

[57] ABSTRACT

A toothbrush construction is described in which a bristle head is made moveable with respect to a handle and contains adjustable springs to permit presetting of the brushing pressure. The springs are so formed as to have a break away feature. The user is thus made aware whenever he exerts more than the preset pressure and can learn to brush at a pressure which permits good cleansing and minimizes brushing damage to his teeth and gingival tissue.

4 Claims, 4 Drawing Sheets

TOOTHBRUSH HAVING ADJUSTABLE BRUSHING PRESSURE

BACKGROUND OF THE PRESENT INVENTION

The present invention relates to a toothbrush provided with adjusting means to control the maximum brushing pressure which may be applied to the teeth during use. Many studies have shown that low brushing pressure results in incomplete removal of dental plaque which acts as a breeding area for cavity-inducing mouth bacteria. Excess pressure on the other hand produces gingival laceration, wear of the enamel, exposure of dentin and subsequent damage such as gingival recession and root exposure. Reliance has been placed on the training of children and adults by dentists and dental hygienists on suitable brushing techniques and on the selection of brushes. Currently recommended brushes have rounded, soft nylon or natural bristles about 0.007 inches in diameter and 12 millimeters long and a density of approximately 3 bristles per square millimeter. Although the use of brushes with these characteristics and the application of recommended techniques represents progress in achieving improved cleaning and limiting abrasive damage, individual differences in brushing pressure tend to produce highly variable results.

Many newer toothbrush concepts have been devised but these have dealt with improvement in brushing efficiency alone. Relatively few of the newer brushes have reflected attempts to regulate the applied pressure. A recent design described in the Journal of Clinical Dentistry, Volume II, No. 4, p 107 of 1991 employs a spring incorporated in the brush handle so that brushing pressure can be more readily monitored by the user (as judged by the amount of flexion). Tests show however that individual differences were still present in judging the optimum pressure to apply.

Other designs have employed specially shaped handles which encourage light gripping—e.g. a "pen grip". The only previously-available effective controls on brushing pressure rely on the provision of hard, medium and soft bristles—or combinations—in individual brushes.

It is one objective of the present invention to provide a linear, flexibly coupled brush and handle which has a "break-away" limit so that pressure in excess of a preset amount causes the handle to move out of the plane of brushing. By maintaining the brush in a useable orientation, the user will automatically maintain the pressure at a value to optimize tooth cleaning and minimize erosive effects.

It is a second objective of the present invention to provide a calibrated adjustability of the break-away pressure so that the setting may be varied to apply to a wide range of individual characteristics.

These and other objectives will be presented in the description and claims given in the following specifications, drawings and claims.

BRIEF DESCRIPTION OF THE DRAWINGS

FIGS. 3, 4 and 5 assume the same amount of applied pressure by the user.

DETAILED DESCRIPTION OF THE INVENTION

Figure 1:
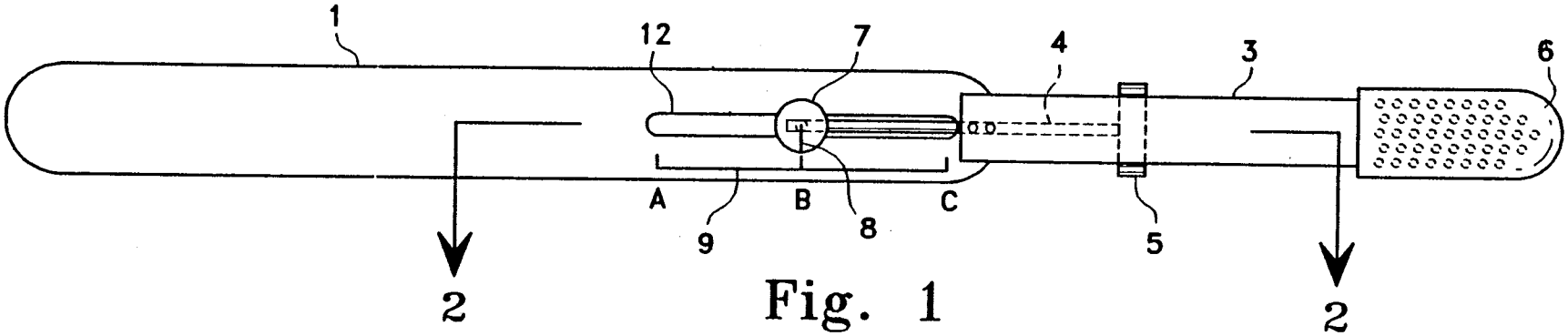
FIG. 1 is a top view of the brush showing the stiffness control button.
Figure 2:
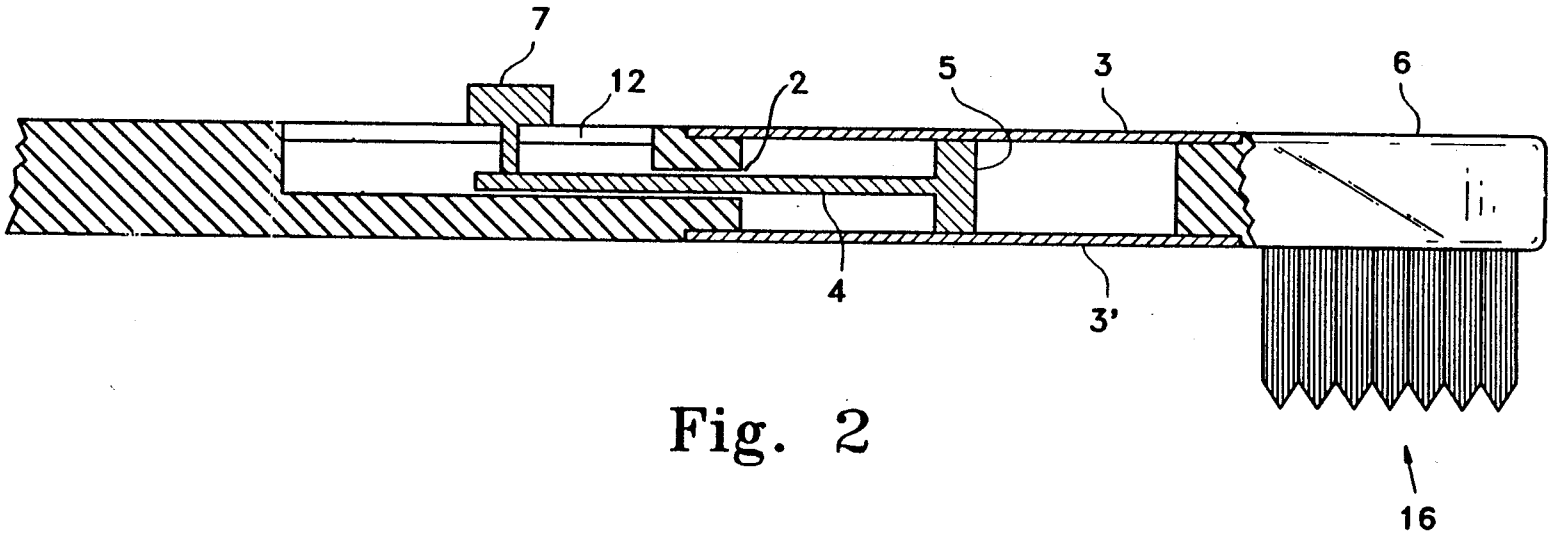
FIG. 2 is a cut-away, side view of the brush taken along 2—2 of FIG. 1 indicating more details of the stiffness adjusting means.
Figure 3:
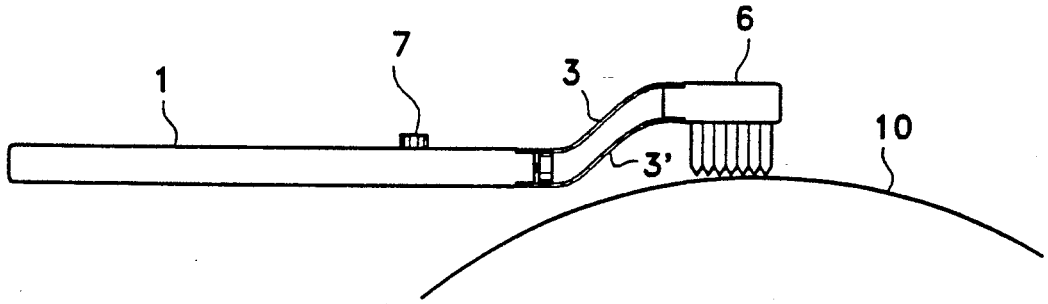
FIG. 3 is a side view of the invention in use with its least setting of the stiffness control.
Figure 4:
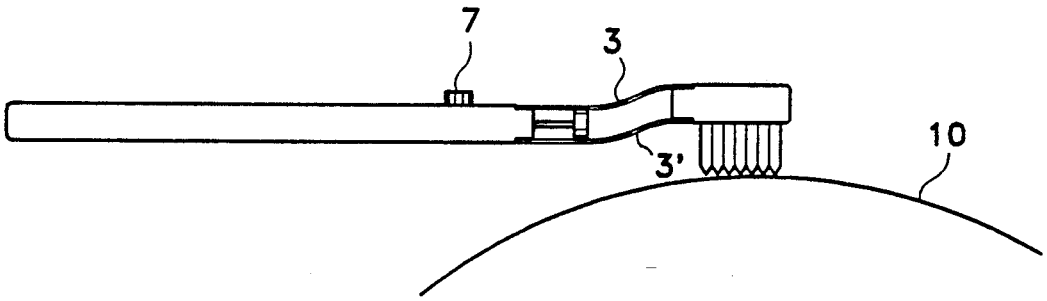
FIG. 4 is a side view of the invention in use in an intermediate stiffness position of its control.
Figure 5:
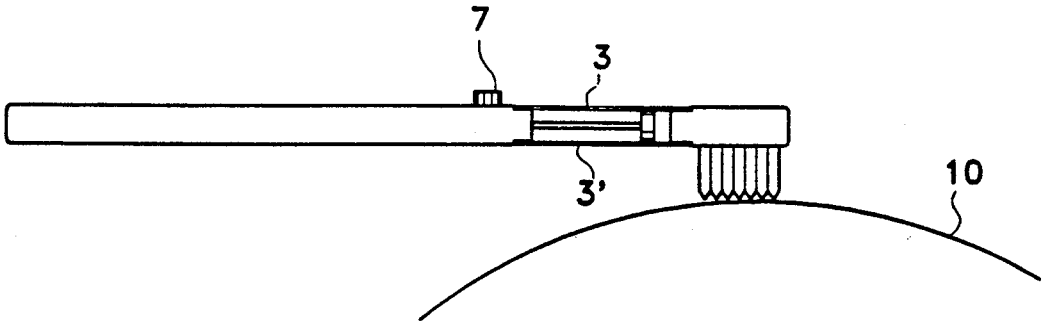
FIG. 5 is a side view of the invention in use with its stiffness setting in the maximum position.

The invention will be explained with reference to FIGS. 1–8. In FIGS. 1 and 2 the toothbrush can be seen to be made up of a handle 1 having an internal slot 12 with an opening 2 in one end. A bristle head 6 is flexibly coupled by the curved-linear springs 3 and 3' to handle 1. When a force 16 is exerted against the bristles, springs 3 and 3' will flex to maintain the plane of the bristles approximately parallel to the handle as shown in FIGS. 3–5. An actuating rod 4, shown in FIG. 2, having an piston 5 is slidably mounted in slot 12 and controlled by button 7 through said slot. The piston 5 is in slideable contact with the inside surfaces of springs 3 and 3'. As the piston 5 is moved towards the bristle head 6, the range of motion of the bristle head becomes more and more limited by virtue of the rigidness of actuating rod 4. When piston 5 is against the bristle head, almost no movement of the latter with respect to the handle or the springs 3 and 3' is possible Button 7 can be positioned at any point along slot 12. The exact point can be reproduced by use of the fiducial mark 8 and the stationary marks A,B,C or by a detent system which latches the button at any of a number of positions.

FIGS. 3, 4 and 5 indicate the amount of flexing of the bristle head obtained with the same amount of force on handle 1 with button 7 in the "soft", "medium" and "stiff" positions. The amount of abrasive action on teeth 10 can thus be made to vary by a considerable amount.

In the manufacture of the invention it would be possible to produce the bristle head and springs as a unit. This would permit replacement of the bristle and springs at regular intervals while the handle and piston arrangement could be reused. It would also be possible to provide slotted, replaceable bristle heads attachable to the springs which would now be a permanent part of the handle.

Figure 6:
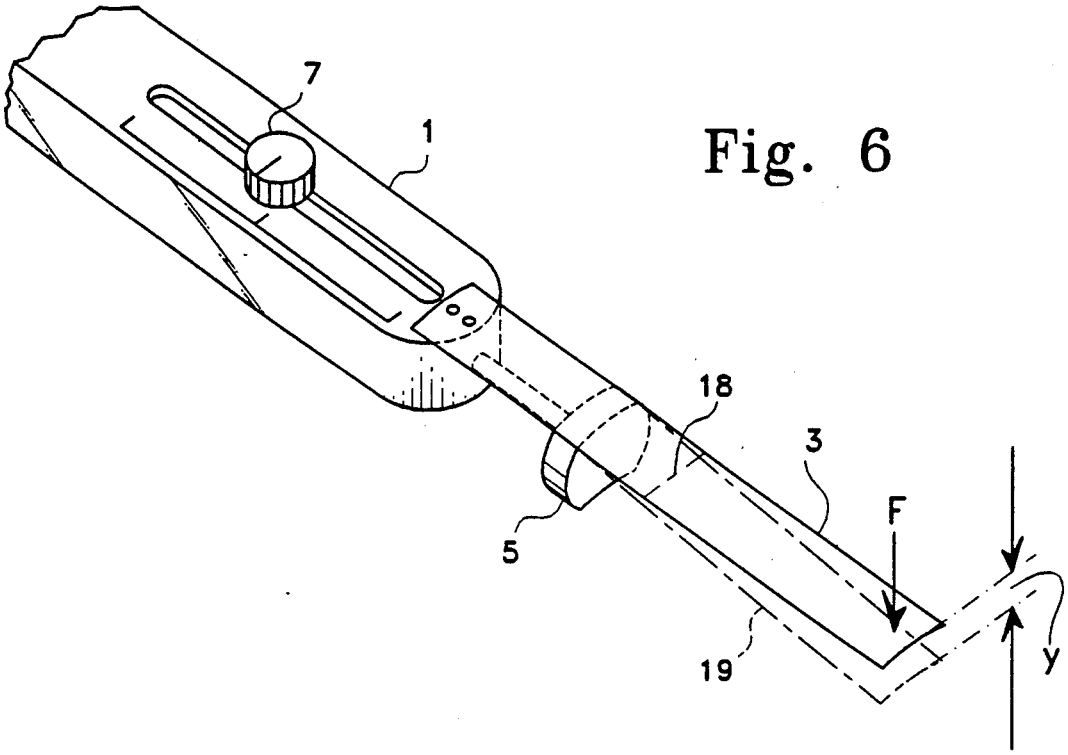
FIG. 6 is a perspective view of part of the invention and is used to explain the operation of the curved linear spring which is a part of the invention.
Figure 7:
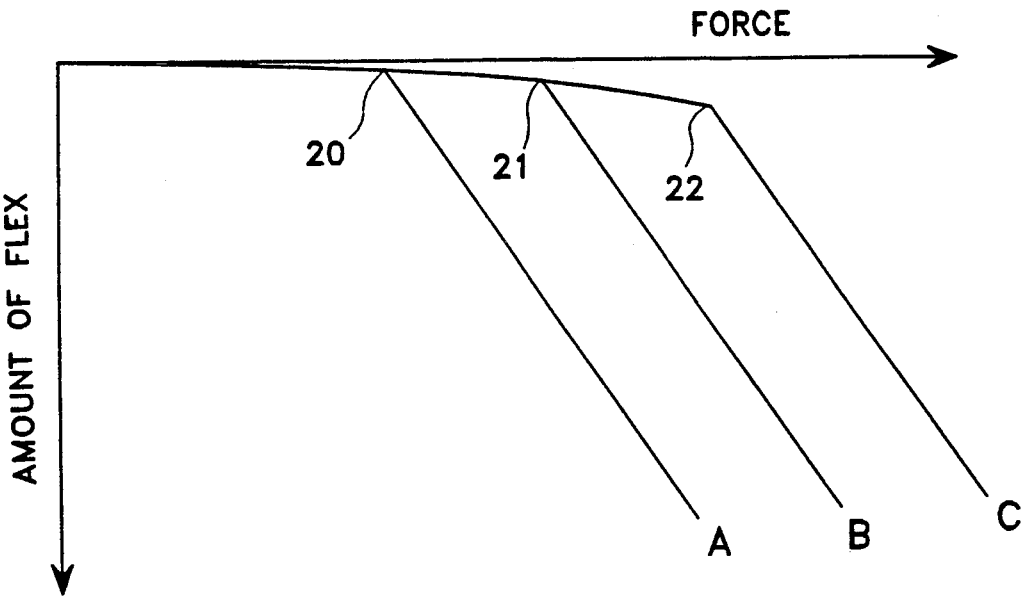
FIG. 7 is a graph of brush head flexing as a function of applied force and indicates the break-away effect achieved in the invention.

The operation of the curved-linear springs 3 and 3' are shown in FIGS. 6 and 7. In FIG. 6 one curved-linear spring 3 is shown as it would be mounted in the handle 1. This kind of spring has two modes of flexing; the straightening of the curve and the flexure of the strip linearly. When a force F is applied as shown, the arch straightens (in the vicinity of piston. After the arch has flattened a transition occurs and, the second mode of flexing occurs. The flattening-straightening mode involves a greater spring constant; the cantilever flexing requires relatively less force. This dual action is shown graphically in FIG. 7. As force F is increased, there is at first little movement of the end of the spring in a cantilever mode. As point 20, 21 or 22 is reached (depending on the setting of button 7), the end of spring breaks away.

Figure 8:
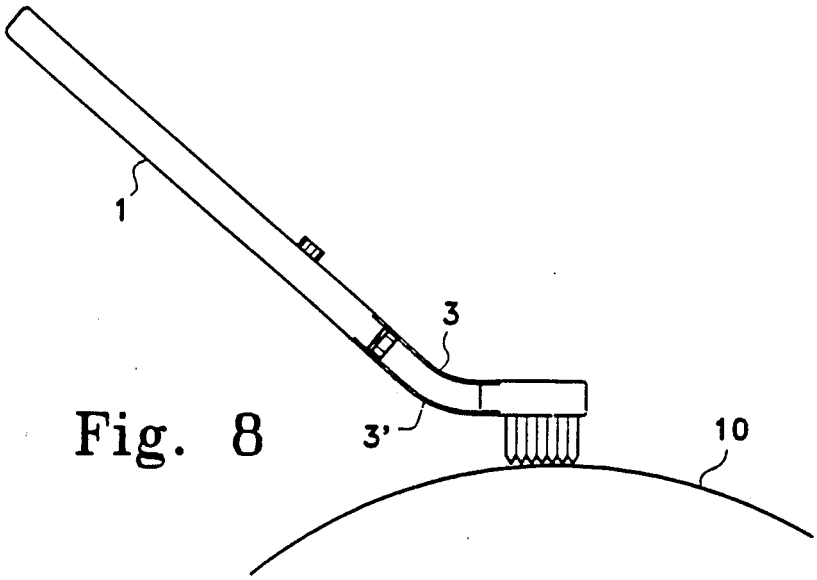
FIG. 8 is a side view of the invention at the break-away point when excess brushing pressure is being exerted.

The individual using the present invention is alerted to his use of excess pressure by the "break away" effect when point 20, 21 or 22 is reached as shown in FIG. 8. By maintaining pressure just under the break away point, the user can maximize plaque removal while minimizing undesirable abrasion and gingival damage. Dentists can recommend settings of the control button as well as bristle density to match individual needs.

What is claimed is as follows.

1. A toothbrush comprising:

(a) an elongated, hollow handle having first and second end portions which define first and second ends respectively, said elongated handle defining a longitudinal axis, said first end portion defining a grasping area for holding the toothbrush and said second end portion having a longitudinal slot therein which communicates with an opening in the second end, said hollow handle slidably supports an elongated actuating rod therein, said rod having first and second ends, said rod extending through said opening to its first end;

(b) a bristle holding head joined to said second end of the handle by a pair of latterly-curved, elongated, linear springs so as to permit limited perpendicular motion of the head with respect to the longitudinal axis;

(c) a piston attached to said first end of the actuating rod, the piston being placed between and having sliding contact with said linear springs;

(d) a slidable control button is attached to the second end of the actuating rod and extends from said handle through said slot, said slot providing a path along which the button can be made to slide such that movement of the button will position the piston at any desired point lengthwise between the linear springs;

(e) marks on the handle along the path of the slidable control button are provided to facilitate locating of the piston at any desired point between said linear springs.

2. A toothbrush as described in claim 1 in which said latterly-curved, elongated linear springs are comprised of flat strips which have been molded to have an arcuate transverse cross section and heat treated so that a first and second mode of flexing occur, the first mode comprising straightening straightening of the arcuate transverse cross section at which point a transition occurs to the second mode which comprises cantilever bending of said strips.

3. A toothbrush as described in claim 2 in which a break away force exists by virtue of the transition, at which transition a toothbrush user becomes aware that a preset brushing pressure has been exceeded.

4. A toothbrush as described in claim 1 in which the force required to move the bristle holding head with respect to the handle can be varied by moving said control button to position the piston at various points between the latterly-curved, elongated, linear springs.

* * * * *